US007871339B2

(12) United States Patent
Sanchez et al.

(10) Patent No.: US 7,871,339 B2
(45) Date of Patent: Jan. 18, 2011

(54) GOLF CLUB WITH SWING BALANCE WEIGHT COVER

(75) Inventors: Richard R. Sanchez, Glendale, AZ (US); Leslie J. Bryant, Peoria, AZ (US); Guillermo G. V ald'via, Phoenix, AZ (US); Gary L. Tuerschmann, Phoenix, AZ (US); Pedro C. Gomez, Peoria, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 1744 days.

(21) Appl. No.: 10/706,481

(22) Filed: Nov. 10, 2003

(65) Prior Publication Data

US 2005/0101408 A1 May 12, 2005

(51) Int. Cl.
*A63B 53/04* (2006.01)

(52) U.S. Cl. ..... 473/335; 473/345

(58) Field of Classification Search ..... 473/324–350
See application file for complete search history.

(56) References Cited

U.S. PATENT DOCUMENTS

| | | | | | |
|---|---|---|---|---|---|
| 3,143,349 | A | | 8/1964 | MacIntyre | |
| 4,340,230 | A | * | 7/1982 | Churchward | 473/339 |
| 4,607,846 | A | * | 8/1986 | Perkins | 473/336 |
| 5,082,278 | A | | 1/1992 | Hsien | |
| 5,154,424 | A | | 10/1992 | Lo | |
| 5,244,210 | A | * | 9/1993 | Au | 473/252 |
| 5,571,053 | A | * | 11/1996 | Lane | 473/336 |
| 5,776,010 | A | * | 7/1998 | Helmstetter et al. | 473/334 |
| 5,795,245 | A | * | 8/1998 | Chang et al. | 473/335 |
| 5,906,549 | A | | 5/1999 | Kubica | |
| 6,015,354 | A | * | 1/2000 | Ahn et al. | 473/256 |
| 6,162,133 | A | * | 12/2000 | Peterson | 473/345 |
| 6,206,790 | B1 | | 3/2001 | Kubica et al. | |
| 6,290,609 | B1 | * | 9/2001 | Takeda | 473/335 |
| 6,409,612 | B1 | * | 6/2002 | Evans et al. | 473/324 |
| 6,648,772 | B2 | * | 11/2003 | Vincent et al. | 473/334 |
| 6,811,496 | B2 | * | 11/2004 | Wahl et al. | 473/334 |
| 6,890,267 | B2 | * | 5/2005 | Mahaffey et al. | 473/256 |
| 6,988,960 | B2 | * | 1/2006 | Mahaffey et al. | 473/345 |
| 2003/0013545 | A1 | | 1/2003 | Vincent et al. | |

FOREIGN PATENT DOCUMENTS

| | | | |
|---|---|---|---|
| JP | 02084972 | A * | 3/1990 |
| JP | 05305162 | A * | 11/1993 |
| JP | 10277187 | A * | 10/1998 |
| JP | 11244433 | A * | 9/1999 |
| JP | 2001149514 | A * | 6/2001 |
| JP | 2001321474 | A * | 11/2001 |
| JP | 2003047678 | A * | 2/2003 |
| JP | 2003169870 | A * | 6/2003 |
| JP | 2004041681 | A * | 2/2004 |

* cited by examiner

*Primary Examiner*—Alvin A Hunter

(57) ABSTRACT

A golf club head includes a balance weight for swing balancing the golf club. The balance weight is selected from a plurality of balance weights and mounted in a weight cavity formed in the golf club head. A cover, imprinted with information such as the club model designation, is mounted to the club head body so that it substantially covers the balance weight. By providing a single cover for each model of golf club, in combination with a plurality of weights that are interchangeable between golf club models, the total number of balance weights that must be maintained in inventory is significantly reduced.

17 Claims, 5 Drawing Sheets

GOLF CLUB WITH SWING BALANCE WEIGHT COVER

BACKGROUND OF THE INVENTION

This invention relates in general to golf clubs and, more particularly, to golf clubs having weight inserts.

The swing weight of a golf club can be thought of as the ratio of the head weight to the grip weight measured at a consistent point of reference, typically 14 inches from the butt end of the club. Swing weights were, at one time, measured in ounces up to as much as 28 ounces, or more. Today, swing weight is most commonly measured on an arbitrary alphabetical scale from "A" to "G", with "A" swing weighted clubs having relatively lower head weight to grip weight ratio and "G" swing weighted clubs having the highest ratio of head weight to grip weight. For a matched set of clubs, the swing weight should be consistent throughout the set for optimum performance (e.g., "$D_3$" for a set of medium swing weighted men's clubs).

Because the swing weight of any particular club is a function of the shaft weight, club head weight, and grip weight, as well as manufacturing tolerances in the weight of all of these, clubs are advantageously swing weighted to the customer's specifications after final assembly. Ordinarily, this is accomplished by attaching a small balance weight to the exterior of the club, usually in a pocket formed in the outside wall of the club for this purpose.

Golf clubs come in many different styles and model designations all of which must be swing weighted at some point during their manufacture. In many cases, the club's model designation is imprinted on the balance weight so that it is visible once the balance weight is installed. Using an imprinted balance weight allows for ready identification of the model designation of the particular golf club. As can be readily determined from the foregoing, in order for a manufacturer to be able to swing weight each of its models across the full range of swing weights, it must maintain a separate inventory of swing weights imprinted for each model of club. Some economy of scale can be achieved by manufacturing the balance weights for each model of club so that they are all the same size and shape. The mass is then varied by varying the density (e.g., by using a tungsten-loaded thermoplastic in which the tungsten density is varied). This way a single mold can be used for all of the balance weights for a single club model. This does not, however, solve the inventory problem engendered by the necessity of having available a complete array of balance weights imprinted with markings for each club model.

One model of prior art iron-type club head 100, as shown in FIGS. 10 and 11, incorporated a two-piece weight 102 disposed in the back face 104 of the club head 100. The club head 100 included a hosel 106 for receiving a golf shaft (not shown) and a cavity 108 for receiving the weight 102. It will be understood that the weight 102 consists of a weight member 110 and a weight cover 112 that is locked in place over the weight member 110 by utilizing clips 114 on the weight cover 112 that snap into grooves 116 in the weight member 110.

SUMMARY OF THE INVENTION

The present invention satisfies the foregoing need by providing a golf club head having a balance weight, selected from a plurality of balance weights, mounted in a weight cavity formed in the golf club head. A cover, which according to an illustrative embodiment is imprinted with information such as the club model designation, is mounted to the club head body so that it substantially covers the balance weight. By providing a single cover for each model of club, in combination with a plurality of weights that are interchangeable between models, the total number of balance weights that must be maintained in inventory is significantly reduced.

BRIEF DESCRIPTION OF THE DRAWING

The present invention will be better understood from a reading of the following detailed description, taken in conjunction with the accompanying drawing figures in which like references designate like elements, and in which.

DETAILED DESCRIPTION

Figure 1:
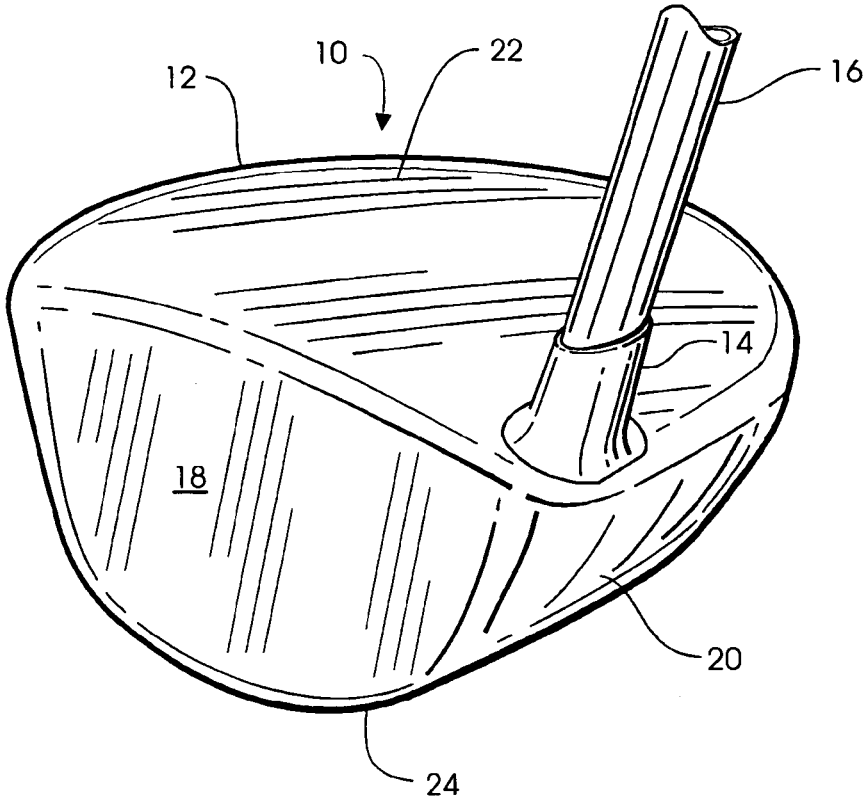
FIG. 1 is a front perspective view of a golf club head incorporating features of the present invention.

The drawing figures are intended to illustrate the general manner of construction and are not necessarily to scale. In the detailed description and in the drawing figures, specific illustrative examples are shown and herein described in detail. It should be understood, however, that the drawing figures and the detailed description are not intended to limit the invention to the particular form disclosed, but are merely illustrative and intended to teach one of ordinary skill how to make, and/or use the invention claimed herein and for setting forth the best mode for carrying out the invention.

Figure 2:
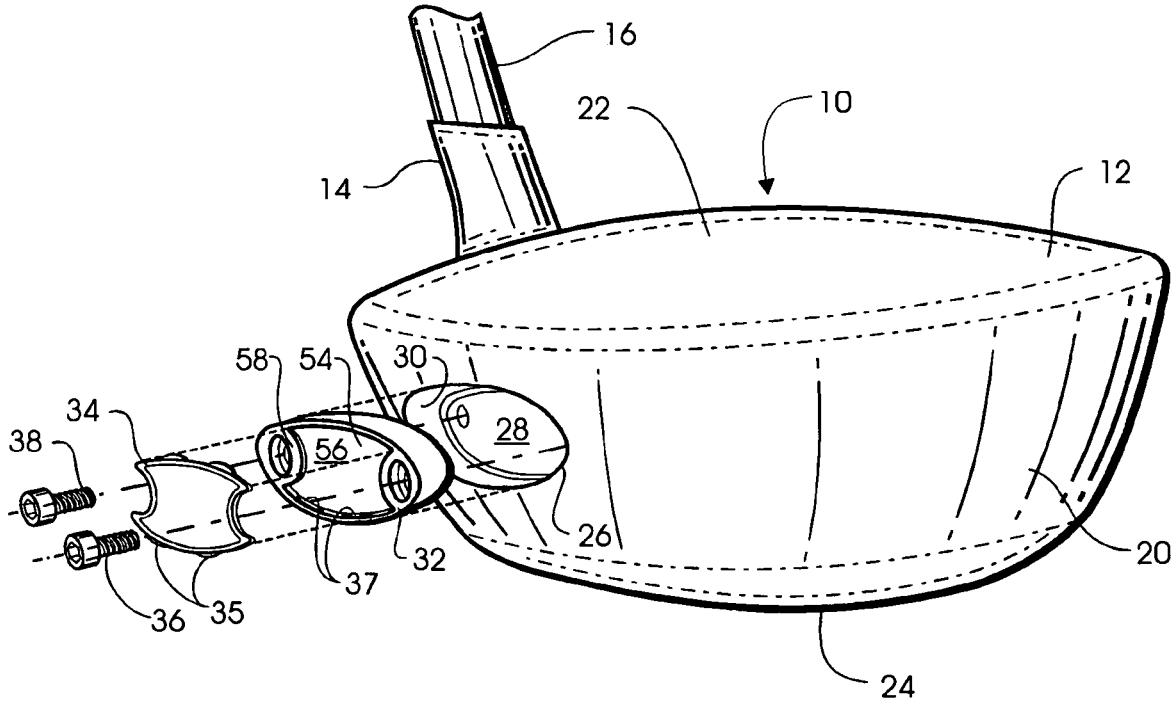
FIG. 2 is a rear exploded perspective view of a golf club head incorporating features of the present invention.

With reference to FIGS. 1 and 2, a golf club head 10 comprises a body 12 and a hosel 14, which is counterbored for receiving one end of a shaft 16. The body 12 has a front face 18 adapted for impacting a golf ball and body surface or skirt 20 disposed between the crown 22 and sole 24 of body 12. Body surface 20 includes a weight cavity 26 defined by a bottom wall 28 and a side wall 30. In the illustrative embodiment, golf club head 10 is a hollow metal wood driver having a weight of approximately 200 grams. The weight cavity 26 is elliptical in shape and measures approximately 35 millimeters along the major axis, 15 millimeters along the minor axis and is approximately 5-10 millimeters in depth.

Figure 3:
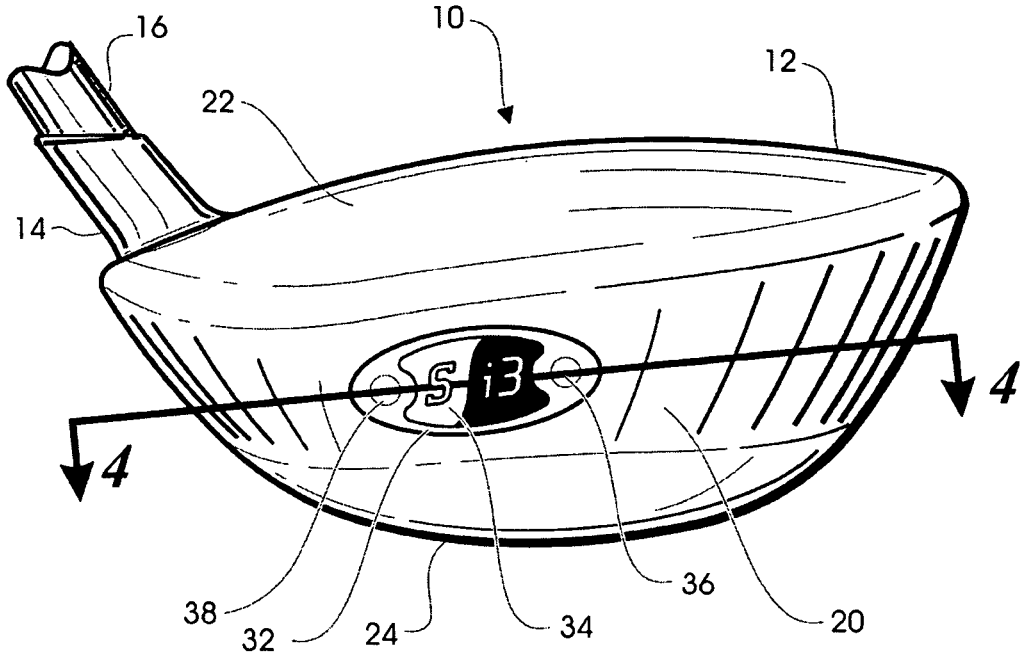
FIG. 3 is a rear perspective view of the club head shown in FIG. 2 as assembled.

Because the golf club head 10 is of a fixed weight, in order to provide the various swing weights necessary to accommodate different shafts and golfer's preferences, a balance weight 32, is selected from a plurality of balance weights and attached to body 12 within cavity 26. In the illustrative embodiment, the plurality of balance weights are identical in size and shape, but range in mass from 2.5 to 21.5 grams in one-gram increments. Once the appropriate balance weight 32 has been attached to body 12, a cover 34 is also attached to the club head body so that it covers substantially all of the balance weight 32. In the embodiment of FIG. 2, cover 34 is attached to balance weight 32 by means of tabs 35 that engage corresponding slots 37 formed in lateral side 52 of balance weight 32. (Alternatively, the tabs 35 could be formed on the balance weight 32 and the slots 37 could be formed in the cover 34.) Cover 34 is selected from a plurality of covers each of which carries information appropriate to the particular golf club, for example the club model designation and any other information of use to the golfer or golf club fitter (e.g., information representative of loft, lie, swing weight, etc.). As shown in FIG. 3, once assembled, the information cover provides a ready means of identifying the club model.

Figure 4:
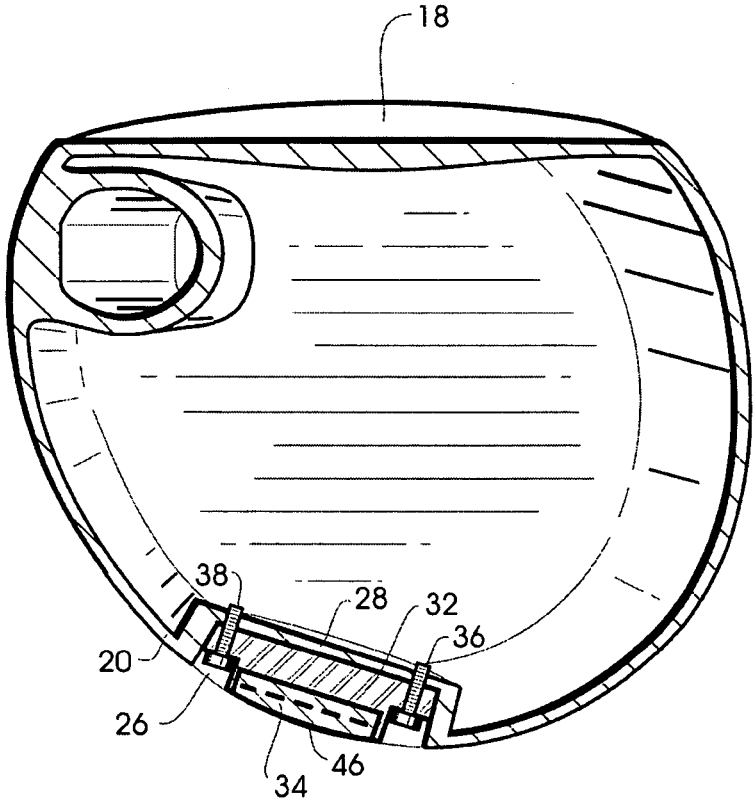
FIG. 4 is a partial cross-section of the club head shown in FIG. 3 taken along line 4-4.
Figure 5:
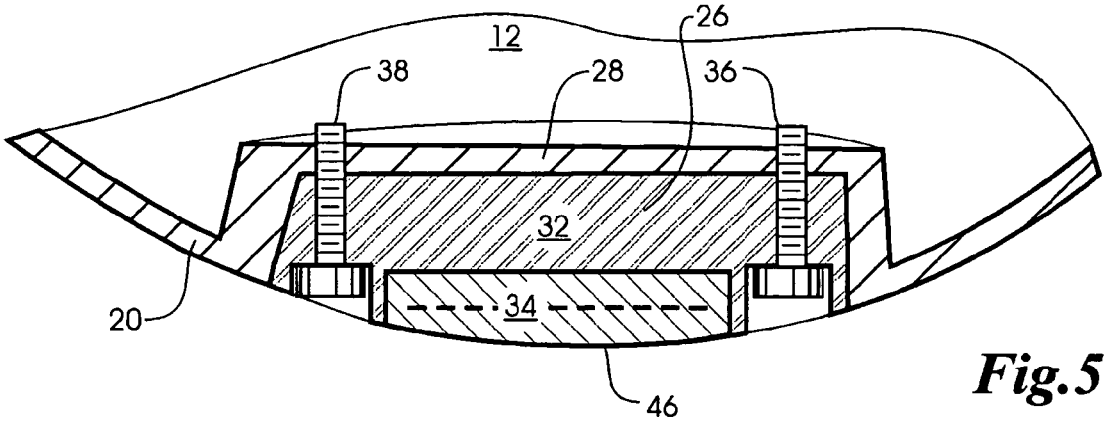
FIG. 5 is an enlarged view of a portion of FIG. 4.

With reference to FIGS. 4 and 5, balance weight 32 is attached to body 12 within weight cavity 26 by means of a pair of threaded fasteners 36 and 38 which are threaded into bottom wall 28 of cavity 26. Preferably an anaerobic adhesive such as LOCTITE is applied to the threads of threaded fasteners 36 and 38 prior to assembly. Once balance weight 32 is installed, cover 34 is attached to balance weight 32. As seen in FIGS. 4 and 5, cover 34 follows substantially the contour of body surface 20 but does not cover the heads of threaded fasteners 36 and 38. This allows threaded fasteners 36 and 38 to be accessible in the event balance weight 32 should need to be changed, for example if a new shaft is installed or the golfer's preferences change.

Figure 6:
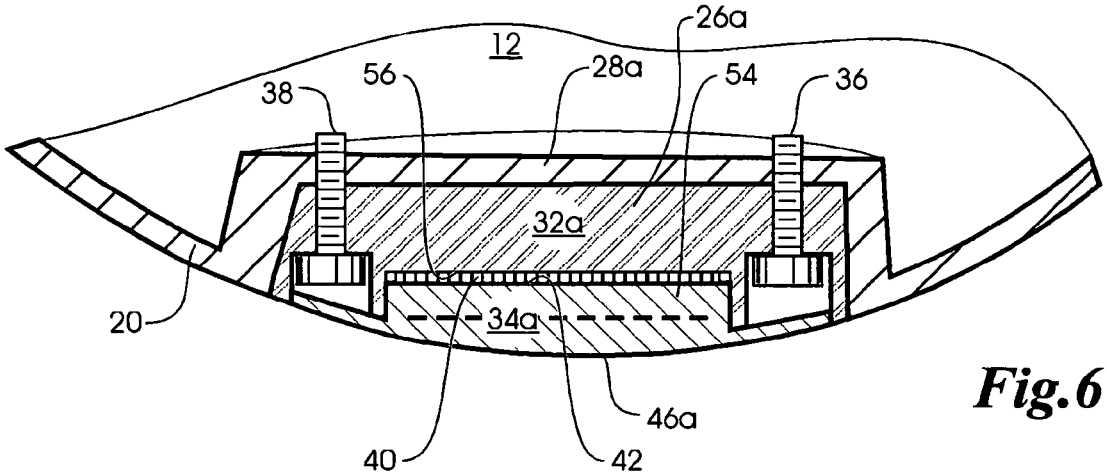
FIG. 6 is an alternative embodiment of a balance weight and cover incorporating features of the present invention.

With reference to FIG. 6, according to an alternative embodiment, balance weight 32*a* is attached to body 12 within weight cavity 26*a* by means of a pair of threaded fasteners 36 and 38 which are threaded into bottom wall 28 of cavity 26*a*. Once balance weight 32*a* is installed, cover 34*a* is attached to balance weight 32*a* within cover cavity 54 by means of a layer of adhesive 40 applied between inner surface 42 of cover 34*a* and floor 56 of cover cavity 54. Outer surface 46*a* of cover 34*a* is formed to follow the general contour of body surface 20 and extends over threaded fasteners 36 and 38 to provide a continuous, smooth surface. Alternatively, as with the embodiment of FIG. 5, outer surface 46 may stop short of threaded fasteners 36 and 38 so that they are easily accessible in the event balance weight 32*a* should need to be changed.

Figure 7:
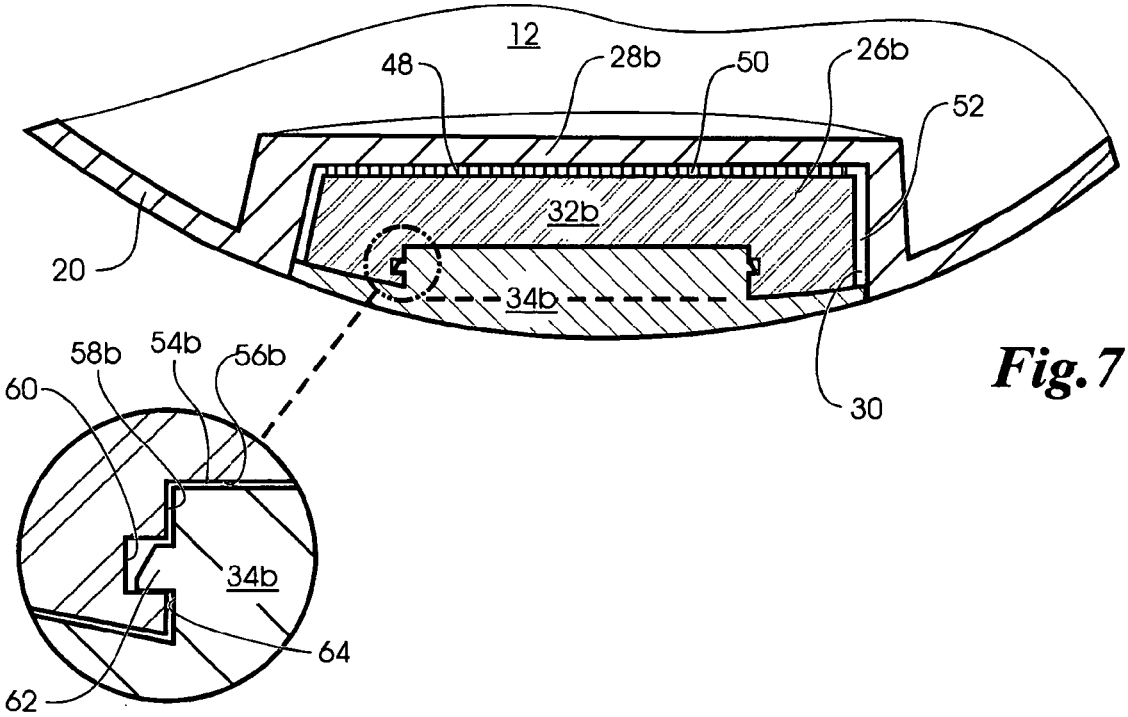
FIG. 7 is another alternative embodiment of a balance weight and cover incorporating features of the present invention.

In another alternative embodiment as shown in FIG. 7, balance weight 32*b* is attached to body 12 within weight cavity 26*b* by applying a layer of adhesive 48 between bottom wall 28*b* of cavity 26*b* and lower surface 50 of balance weight 32*b* as well as between side wall 30*b* of cavity 26*b* and lateral side 52 of balance weight 32*b*. Cover cavity 54*b* is defined by a floor 56*b* and reveal 58*b* in which is formed a slot 60. A corresponding tab 62 is formed in the perimeter surface 64 of cover 34*b*. Once balance weight 32*b* has been attached to body 12 cover 34*b* is attached to balance weight 32*b* by snapping tab 62 into the corresponding slot 60.

Figure 8:
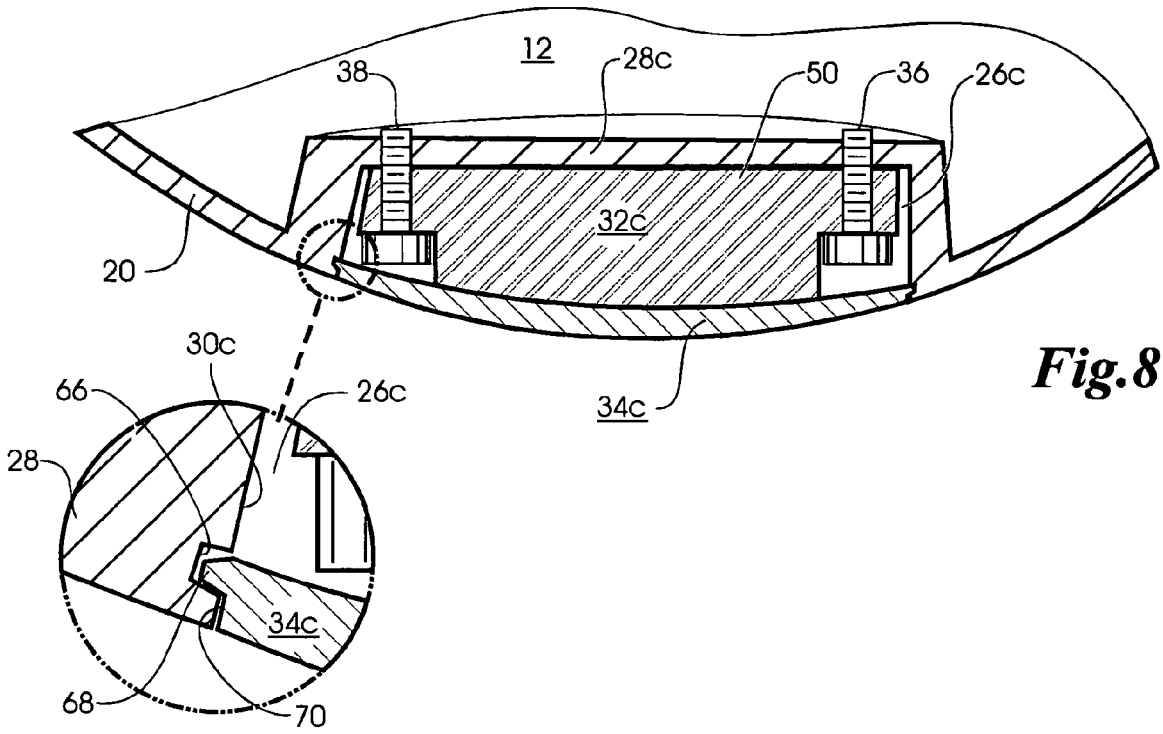
FIG. 8 is an additional alternative embodiment of a balance weight and cover incorporating features of the present invention.

With reference FIG. 8, in an additional alternative embodiment, balance weight 32*c* is attached to body 12 inside weight cavity 26*c* by means of threaded fasteners 36 and 38 which are threaded into bottom wall 28*c* of cavity 26*c*. A slot 66 is formed in side wall 30*c* of cavity 26*c*. A corresponding tab 68 is formed in the perimeter surface 70 of cover 34*c*. Once balance weight 32*c* is installed, cover 34*c* is installed by snapping tab 68 into corresponding slot 66 formed in side wall 30*c* of weight cavity 26.

Figure 9:
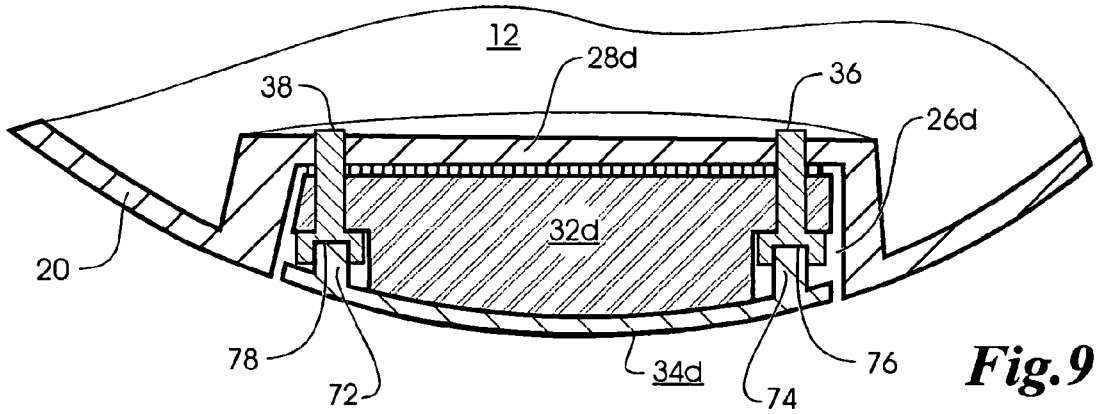
FIG. 9 is yet another alternative embodiment of a balance weight and cover incorporating features of the present invention.
Figure 10:
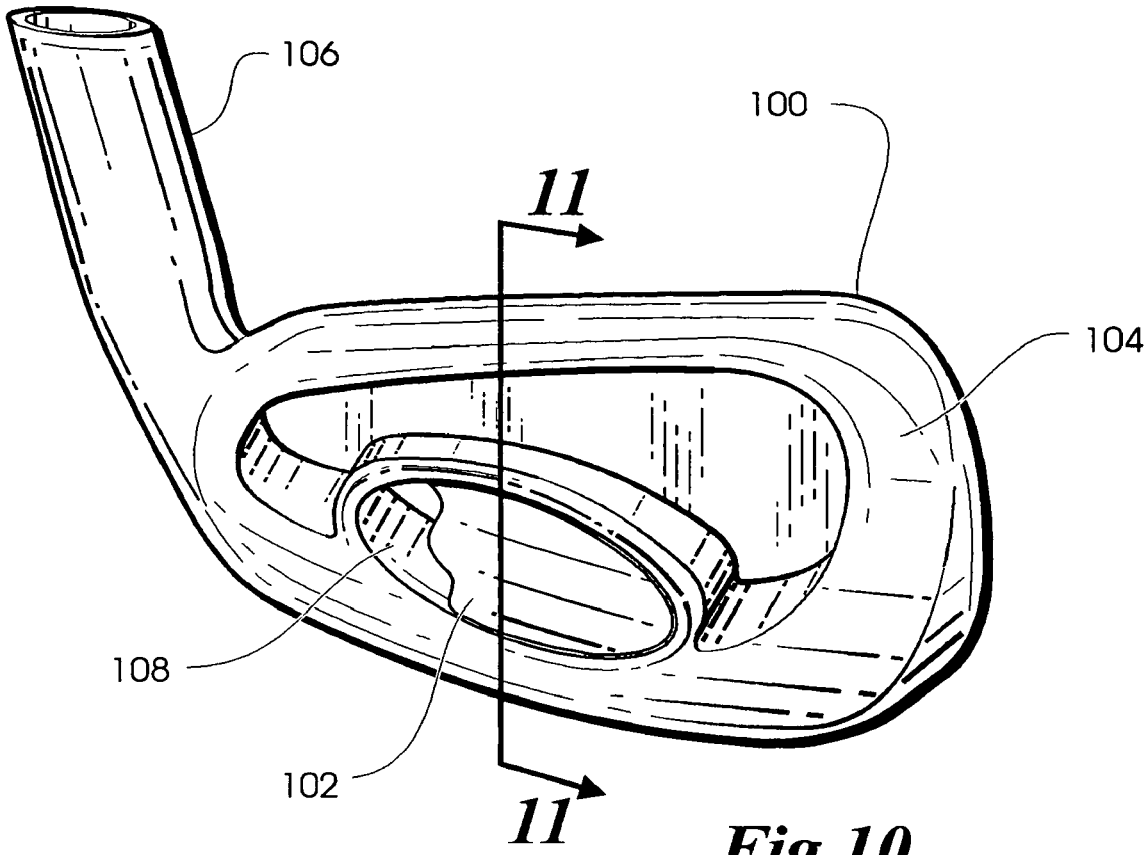
Fig.10 Prior Art
FIG. 10 is a rear perspective view of a prior art iron-type club head.
Figure 11:
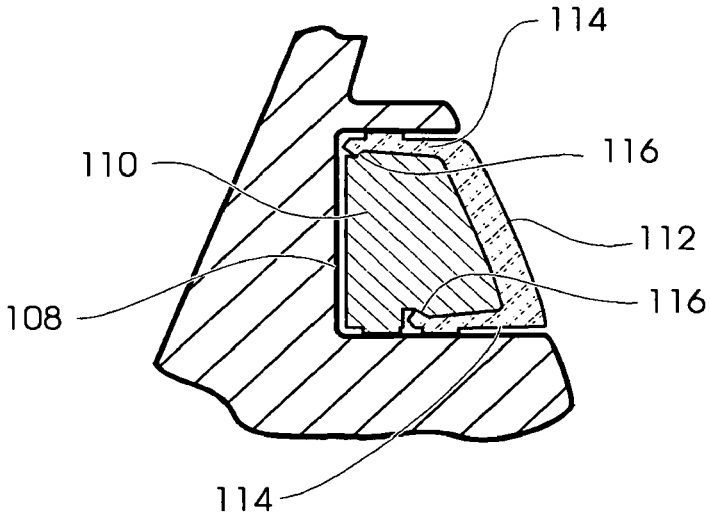
Fig.11 Prior Art
FIG. 11 is a cross sectional view of the club head of FIG. 10. taken along line 11-11.

With reference FIG. 9, in yet another alternative embodiment, balance weight 32*d* is attached to body 12 inside weight cavity 26*d* by means of threaded fasteners 36 and 38 which are threaded into bottom wall 28*d* of cavity 26*d*. Cover 34*d* is then installed by pressing a plurality of pins 72, 74 into the corresponding recesses 76, 78 formed in the heads of threaded fasteners 36 and 38. Optionally, an adhesive, such as a cyanoacrylate adhesive may be used to permanently secure cover 34*d* to balance weight 32*d*

Although certain illustrative embodiments and methods have been disclosed herein, it will be apparent from the foregoing disclosure to those skilled in the art that variations and modifications of such embodiments and methods may be made without departing from the spirit and scope of the invention. For example, an adhesively bonded balance weight in cooperation with a cover that snaps into a slot formed into the side wall of the cavity, threaded weight in cooperation with a cover that is adhesively bonded to the weight cavity or any combination of threaded, bonded, or snap-in attachments are all considered within the scope of the present invention. Accordingly, it is intended that the invention should be limited only to extent required by the appended claims and the rules and principals of applicable law.

What is claimed is:

1. A method of manufacturing a golf club head, comprising:

forming a club head body comprising a hollow body having a face adapted for impacting a golf ball, said club head body further comprising a body surface having a weight cavity formed therein, the weight cavity being defined by a side wall and a bottom wall;

providing a plurality of balance weights, each of said plurality of balance weights having an upper surface, a lower surface and a lateral side joining the upper surface and the lower surface;

selecting one of said plurality of balance weights;

attaching said one of said plurality of balance weights rigidly to said club head body within the weight cavity;

providing a plurality of covers, each of said covers comprising an outer surface, an inner surface and a perimeter wall;

selecting one of said plurality of covers; and attaching said one of said plurality of covers to said club head body so that said cover substantially covers said one of said plurality of balance weights.

2. The method of claim 1, wherein:

said plurality of balance weights comprise weights of differing mass.

3. The method of claim 1, wherein:

said plurality of balance weights comprise weights of differing densities.

4. The method of claim 1, wherein:

said attaching of said one of said plurality of balance weights rigidly to said club head body within the weight cavity comprises bonding the lateral side of said one of said plurality of balance weights rigidly to the side wall of the cavity.

5. The method of claim 1, wherein:

said attaching of said one of said plurality of balance weights rigidly to said club head body within the weight cavity comprises bonding the lower surface of said one of said plurality of balance weights rigidly to the bottom wall of said weight cavity.

6. The method of claim 1, wherein:

said attaching of said one of said plurality of balance weights rigidly to said club head body within the weight cavity comprises securing said one of said plurality of balance weights to the bottom wall of said weight cavity with screw fasteners.

7. The method of claim 1, further comprising:

forming a slot in the side wall of the weight cavity; and forming a corresponding tab on the perimeter wall of the cover, and wherein said attaching of said one of said plurality of covers to said golf club head so that said cover substantially covers said one of said plurality of balance weights comprises snapping the tab on the perimeter wall of the cover into the slot formed in the side wall of the weight cavity.

8. The method of claim 1, wherein:

each of said plurality of balance weights further comprising a cover cavity formed in the upper surface, the cover cavity comprising a floor and a reveal.

9. The method of claim 8, further comprising:

forming a slot in the reveal of the cover cavity; and forming a corresponding tab on the perimeter wall of the cover, and wherein said attaching of said one of said plurality of covers to said golf club head so that said cover substantially covers said one of said plurality of balance weights comprises snapping the tab on the perimeter wall into the slot formed in the reveal of the cover cavity.

10. The method of claim 8, wherein:

said attaching of said one of said plurality of covers to said golf club head so that said cover substantially covers said one of said plurality of balance weights comprises bonding said cover to the cover cavity.

11. A golf club head comprising:

a club head body comprising a hollow body having a face adapted for impacting a golf ball, said club head body further comprising a body surface having a weight cavity formed therein, the weight cavity being defined by a side wall and a bottom wall;

a balance weight disposed within said weight cavity and attached rigidly to said club head body, said balance weight selected from a plurality of balance weights, each of said plurality of balance weights having an upper surface, a lower surface and a lateral side joining the upper surface and the lower surface, said plurality of balance weights comprising weights having different masses; and a cover selected from a plurality of covers and attached to said club head body so that said selected cover substantially covers said balance weight, each of said plurality of covers having an outer surface, an inner surface and a perimeter wall.

12. The golf club head of claim 11, wherein:

said plurality of balance weights comprise weights of different densities.

13. The golf club head of claim 11, wherein:

said cover includes a plurality of tabs and said balance weight further includes a plurality of corresponding slots, said tabs and slots cooperating to attach said cover to said balance weight.

14. The golf club head of claim 11, wherein:

said cover is imprinted with information including a model designation for said golf club head.

15. The golf club head of claim 11, wherein:

said club head body further comprises a crown and a sole; and said body surface is disposed between said crown and said sole.

16. The golf club head of claim 15, wherein said weight cavity is located in a substantially rearward direction from said face.

17. A method of manufacturing plural golf club heads of different model designations, comprising:

forming a first club head body of a first model designation comprising a first hollow body having a first face adapted for impacting a golf ball, said first club head body further comprising a first body surface having a first weight cavity formed therein, said first weight cavity having first interior dimensions defined by a side wall and a bottom wall;

forming a second club head body of a second model designation comprising a second hollow body having a second face adapted for impacting a golf ball, said second club head body further comprising a second body surface having a second weight cavity formed therein, said second weight cavity having second interior dimensions defined by a side wall and a bottom wall, said second club head body having an exterior profile generally different from said first club head body, but said second interior dimensions being substantially the same size as said first interior dimensions;

providing a plurality of balance weights, each of said plurality of balance weights having an upper surface, a lower surface and a lateral side joining the upper surface and the lower surface sized to conform to said interior dimensions;

selecting a first one of said plurality of balance weights;

attaching said first one of said plurality of balance weights rigidly to said first weight cavity;

selecting a second one of said plurality of balance weights;

attaching said second one of said plurality of balance weights rigidly to said second weight cavity;

providing a first plurality of covers, each of said first plurality of covers comprising an outer surface, an inner surface, a perimeter wall and markings indicative of a feature of said first model designation;

selecting one of said first plurality of covers;

attaching said one of said first plurality of covers to said first club head body so that said one of said first plurality of covers substantially covers said first weight cavity;

providing a second plurality of covers, each of said second plurality of covers comprising an outer surface, an inner surface, a perimeter wall and markings indicative of a feature of said second model designation;

selecting one of said second plurality of covers; and attaching said second one of said second plurality of covers to said second club head body so that said second one of said second plurality of covers substantially covers said second weight cavity;

whereby a single plurality of balance weights may be used to swing balance a plurality of different models of golf clubs.

* * * * *